US006893172B2

(12) United States Patent
Nakamura et al.

(10) Patent No.: US 6,893,172 B2
(45) Date of Patent: May 17, 2005

(54) DEVELOPING APPARATUS AND DEVELOPING METHOD

(75) Inventors: Akihiko Nakamura, Kanagawa (JP); Yoshihiro Inao, Kanagawa (JP)

(73) Assignee: Tokyo Ohka Kogyo Co., Ltd., Kanagawa (JP)

( * ) Notice: Subject to any disclaimer, the term of this patent is extended or adjusted under 35 U.S.C. 154(b) by 0 days.

(21) Appl. No.: 10/780,010

(22) Filed: Feb. 17, 2004

(65) Prior Publication Data

US 2004/0165883 A1 Aug. 26, 2004

(30) Foreign Application Priority Data

Feb. 20, 2003 (JP) ..... 2003-043139
Dec. 19, 2003 (JP) ..... 2003-423291

(51) Int. Cl.[7] ..... G03D 5/00; B05C 11/02; B05D 3/12

(52) U.S. Cl. ..... 396/611; 396/571; 118/52; 427/240

(58) Field of Search ..... 396/571, 572, 396/573, 611, 627; 118/52; 427/240

(56) References Cited

U.S. PATENT DOCUMENTS

2003/0077083 A1 * 4/2003 Yamamoto et al. ..... 396/611
2003/0165756 A1 * 9/2003 Ono et al. ..... 430/30

FOREIGN PATENT DOCUMENTS

| | | |
|---|---|---|
| JP | 56-160035 | 12/1981 |
| JP | 60-142517 | 7/1985 |
| JP | 06-045244 | 2/1994 |
| JP | 07-326559 | 12/1995 |
| JP | 2002-208579 | 7/2002 |

* cited by examiner

*Primary Examiner*—Alan Mathews
(74) *Attorney, Agent, or Firm*—Carrier, Blackman & Associates, P.C.; Joseph P. Carrier; William D. Blackman

(57) ABSTRACT

A developing apparatus which enables the time necessary for a development reaction to be shortened and permits uniform development includes a chuck device with a support portion whose top surface is a horizontal surface and a spinner disposed in the middle of this support portion. The support portion and the spinner are provided within an antiscattering cup. A groove which vacuum adsorbs a substrate W to be treated is formed on the top surface of the spinner, a pipe which forms a circulation path is disposed within the groove formed on the top surface of the support portion, and a cleaning nozzle which cleans a developing solution which has flown behind the rear surface of the substrate W is disposed in a position which is nearest to the inside diameter of the top surface of the support portion. On the other hand, in a nozzle device, a spray nozzle is attached to a horizontally reciprocating arm via a columnar support. A developing solution pipe and an air supply pipe are inserted into this spray nozzle and a temperature-regulated developing solution from the developing solution supply pipe is spouted in mist form from the bottom end of the spray nozzle.

20 Claims, 7 Drawing Sheets

DEVELOPING APPARATUS AND DEVELOPING METHOD

BACKGROUND OF THE INVENTION

1. Field of the Invention

The present invention relates to a developing apparatus and a developing method and, more particularly, to an apparatus and a method for developing a thick film photoresist of not less than 10 μm, for example.

2. Description of the Background Art

There has hitherto been known a method by which a photoresist is applied to a substrate to be treated, such as a semiconductor wafer, a circuit pattern is transferred to the photoresist by using photolithography technology, and a developing solution is supplied to a surface on which an undeveloped image pattern is formed, whereby a developed image pattern is formed on the front surface of the substrate to be treated by developing the applied resist film to form a circuit.

Developing equipment includes a developing apparatus in which a substrate to be treated is immersed in a developing solution, a developing apparatus in which a developing solution is caused to flow as a shower on the front surface of a substrate to be treated, and a paddle type developing apparatus in which a developing solution is applied over a photoresist on the front surface of a substrate to be treated and the developing solution is thrown off by rotating the substrate to be treated after a lapse of a predetermined time.

Prior arts of paddle type developing apparatus in which a developing solution is sprayed in mist form are exemplified below.

There is known a developing method by which after the completion of the paddle development, a developing solution and nitrogen gas are mixed at a ratio of 1:1 and the mixture is sprayed in mist form during the rotation of a wafer so that no scum of a photoresist film remains on the wafer. (Patent Document 1)

There is also known a paddle developing method by which a developing solution and nitrogen (air) are supplied to a nozzle via separate pipes and the developing solution is sprayed in spray form, thus permitting high accuracy development treatment. (Patent Document 2)

There is further known a paddle developing method by which a developing solution supply pipe and a gas supply pipe are caused to face an umbrella-like concave portion formed at the bottom end of a nozzle and a developing solution is supplied to a substrate in the form of a high velocity mist. (Patent Document 3).

On the other hand, in the prior art of paddle type developing apparatus, there is known a means of preventing a developing solution from flowing behind the rear surface of a wafer after the development performed by dropping the developing solution. (Patent Document 4) (Patent Document 5)

[Patent Document 1] Japanese Patent Laid-Open No. 6-45244

[Patent Document 2] Japanese Patent Laid-Open No. 7-326559

[Patent Document 3] Japanese Patent Laid-Open No. 2002-208579

[Patent Document 4] Japanese Patent Laid-Open No. 56-160035

[Patent Document 5] Japanese Patent Laid-Open No. 60-142517

Spraying a developing solution in mist form in performing paddle type development can reduce the consumption of a developing solution and is desirable from the standpoint of uniform treatment.

In the cited Document 1 to Document 4, however, in all of the prior arts, a developing solution is used at room temperature and, therefore, the development time is long, posing the problem that the development treatment rate decreases.

Furthermore, although it is possible to maintain the temperature of a developing solution at a predetermined level until the moment the developing solution is delivered, the temperature and concentration of the solution change due to vaporization after the delivery, with the result that it is difficult to maintain a prescribed performance of the developing solution, and posing the problem that an unevenness of development tends to occur.

In addition, a developing solution flows behind the rear surface of a wafer, posing the problem that a spinner shaft becomes dirty easily.

Incidentally, in Patent Document 4, the liquid is prevented from flowing behind the rear surface of a wafer by forming a fan portion on a wafer chuck. However, the fan portion extends in a radial pattern as part of the wafer chuck and the total surface area which cuts the air during rotation is wide. Therefore, considerable air resistance occurs during the rotation of this wafer chuck and a load to a rotary shaft increases, with the result that the start-up of rotation requires time, leading to a decrease in production efficiency.

On the other hand, in Patent Document 4, there is also an example in which a wafer chuck portion and a blowing member on which a fan is mounted are separated from each other so that an increase in load to a rotary shaft is prevented. In the case of poor gap adjustment or in the case of a large face runout of a wafer, a fan and the wafer come into contact with each other and the wafer might be damaged. Conversely, when the gap is too large, the fan effect decreases, posing the problem that adjustment is difficult.

In FIG. 3 of Patent Document 5, a fan is attached to a spindle on the side of the rear surface and streams of air current are formed from the center of the spindle to the circumference thereof by use of the fan. However, it is necessary to provide two members, i.e., the fan which forms the streams of air current from the center of the spindle to the circumference thereof and an inlet port which sucks in the streams of air current, and the mechanism becomes complicated, posing the problem that the cost increases.

The present invention was made in view of the above-described problems and has as its object the provision of a developing apparatus and a developing method which shorten the development time of a resist (in particular, with a thick film of not less than 10 μm) and permit uniform development.

SUMMARY OF THE INVENTION

In order to solve the above-described problems, the present invention provides a paddle type developing apparatus of photoresist in which a developing solution from a nozzle is supplied to an object to be treated, which is held by a chuck device, and the developing solution on the object to be treated is thrown off by rotating a spinner constituting the chuck device after a lapse of a prescribed time. The paddle type developing apparatus comprises a nozzle which mixes a developing solution and air and spouts a developing solution in mist form and at least part of a developing solution pipe leading to this nozzle is disposed within a circulation path of temperature adjusting water.

In order to ensure further shortening of the development time and further uniform development, it is desirable that the temperatures of the chuck device, the air to be mixed with the developing solution and the air to be fed into the developing apparatus be also adjusted. The circulation path of the temperature adjusting water may be used as temperature adjusting means or other means may be used for this purpose.

Incidentally, conceivable variations of the developing apparatus are a developing apparatus which is configured to have a blower which feeds the temperature-adjusted air into the developing apparatus and a preheating device which beforehand heats the object to be treated before the transfer of this object into the developing apparatus, and a developing apparatus which is configured in such a manner that a nozzle which spouts a developing solution in mist form is disposed with an antiscattering cup.

In the developing method related to the present invention, by use of the above-described developing apparatus the temperature of the above-described developing solution, the temperature of the chuck device, the temperature of above-described air to be mixed with the developing solution and/or the temperature of the above-described air to be fed into the developing apparatus should be regulated to not less than 30° C. but less than 60° C. The reason why the regulated temperature is not less than 30° C. is that the effect on the shortening of the developing reaction time is small at a regulated temperature of less than 30° C. and that at a regulated temperature exceeding 60° C., the photoresist film might discolor and swell, causing damage.

The following table (Table 1 appearing just before the claims) shows a comparison of the treatment time, the amount of a solution used and the possibility of uniform development between the apparatus of the present invention (air nozzle: 40° C.) and conventional apparatus (paddle type and shower type) when PMER LA-900 made by Tokyo Ohka Kogyo Co., Ltd. was used as a photoresist, PMER-7G made by the same company was used as a developing solution and a 5 inch wafer was used as the substrate size.

BRIEF DESCRIPTION OF THE DRAWINGS

FIG. 6(*b*) is a plan view of a chuck portion of the apparatus in FIG. 6(*a*) observed from above;

FIG. 6(*c*) includes enlarged explanatory views of a section 4 of the chuck portion indicated at 45 in FIG. 6(*a*)

DETAILED DESCRIPTION OF THE INVENTION

Figure 1:
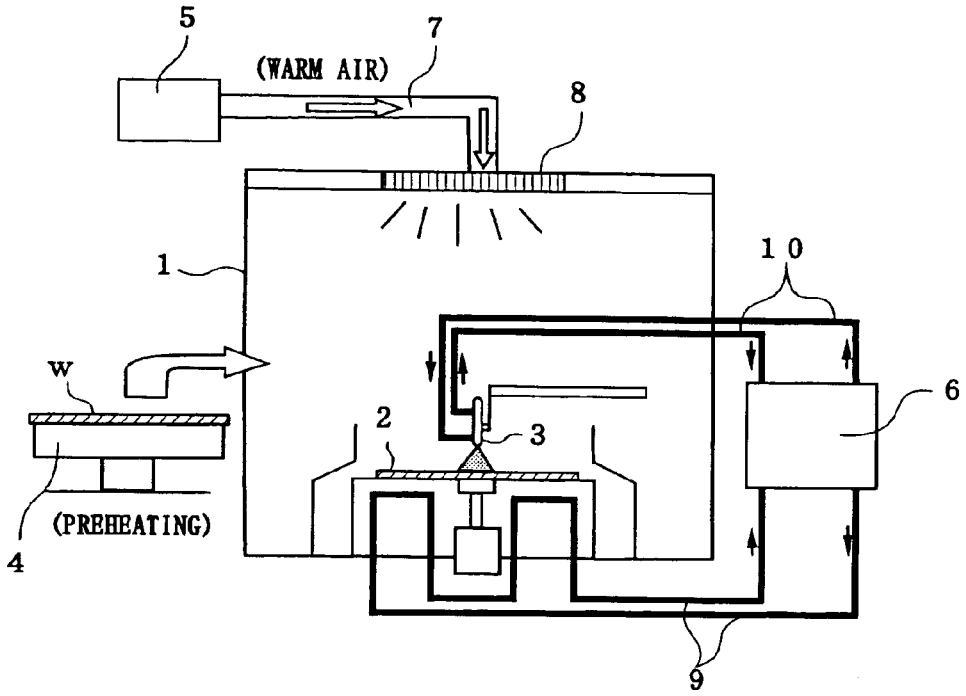
FIG. 1 is a general view of a developing apparatus related to the present invention.
Figure 2:
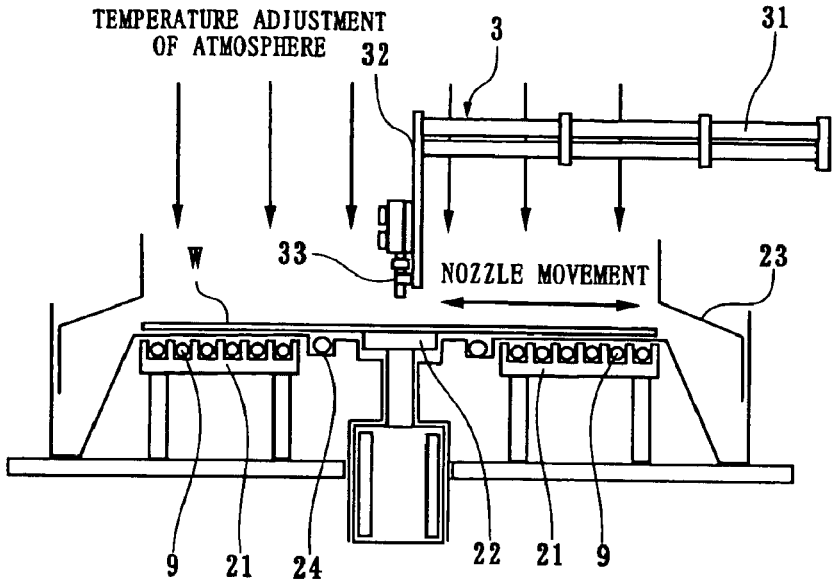
FIG. 2 is a partial enlarged view of the same developing apparatus.
Figure 3:
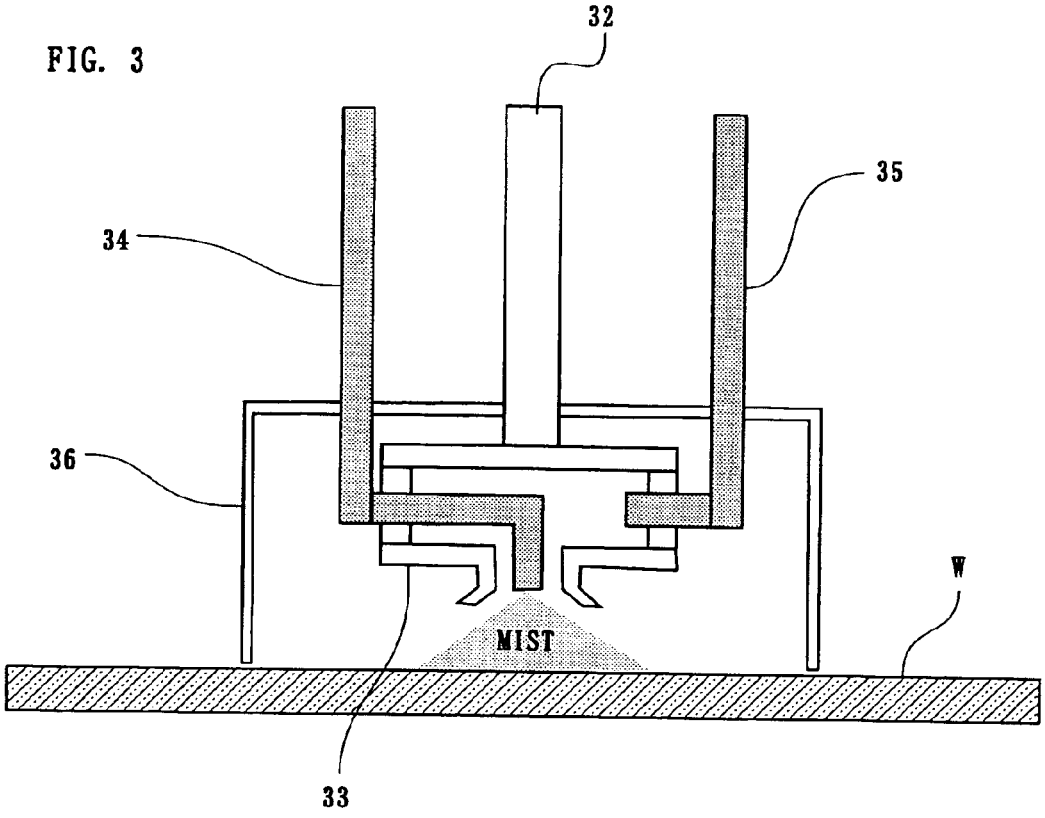
FIG. 3 is an enlarged view of a tip portion of a nozzle.
Figure 4:
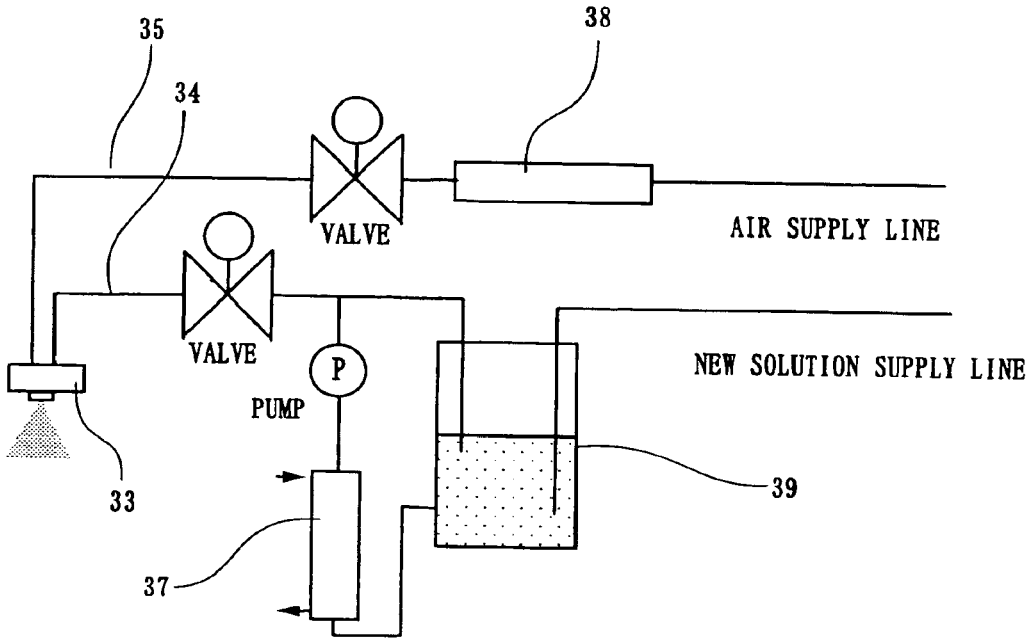
FIG. 4 is a view to explain a piping system according to the invention.
Figure 5:
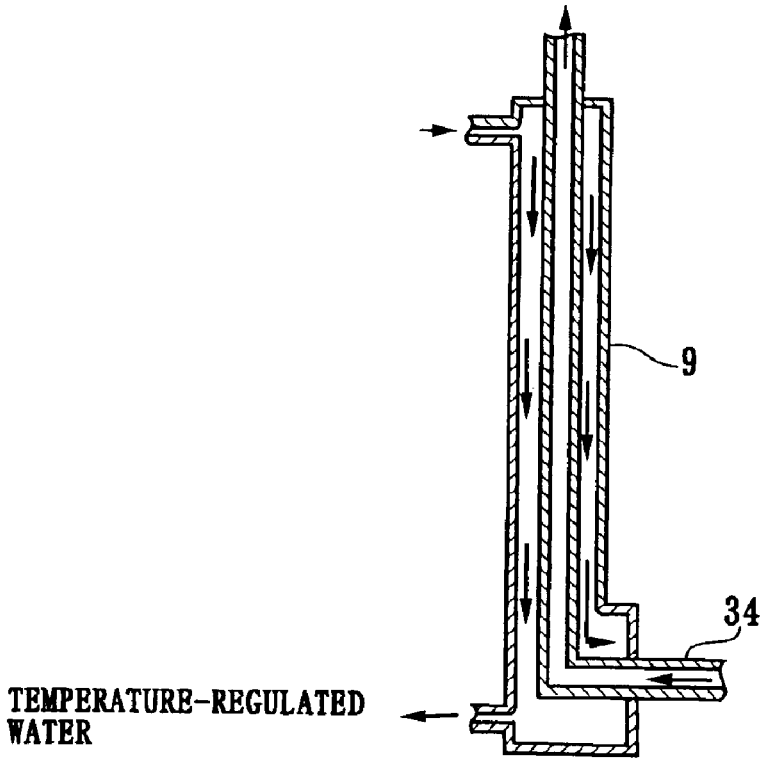
FIG. 5 is an enlarged sectional view of a temperature regulating portion (heater) for an applied solution according to the invention.

Embodiments of the present invention will be described below in conjunction with the attached drawings. FIG. 1 is a general view of a developing apparatus related to the present invention. FIG. 2 is a partial enlarged view of the same developing apparatus. FIG. 3 is an enlarged view of a tip portion of a nozzle. FIG. 4 is a view to explain a piping system. FIG. 5 is an enlarged sectional view of a temperature regulating portion.

In the developing apparatus, a chuck device 2 and a nozzle device 3 are arranged within a case 1 and a hot plate (heater) 4, a blower 5 and a temperature regulator 6 are arranged outside the case 1. The hot plate 4 performs the pre-heating of a substrate W to be treated before treatment, and the blower 5 feeds the air which is regulated to not less than 30° C. but less than 60° C. into the case 1 via a blast pipe 7 and a filter 8. Circulation paths 9, 10 of temperature-regulated water, which is regulated to not less than 30° C. but less than 60° C., lead from the temperature regulator 6. The temperature of the chuck device 2 is regulated by the circulation path 9, as will be described later, and the temperature of the developing solution supply pipe leading to the nozzle device 3 is regulated by the circulation path 10, as will be described later.

As shown in FIG. 2, the chuck device 2 comprises a support portion 21 whose top surface is a horizontal surface and a spinner 22 which is disposed in the middle of this support portion 21, and these members are provided within an antiscattering cup 23.

Because the chuck device 2 is set to a desired temperature in this manner, the substrate W, which is the object to be treated, is held so that the temperature of this substrate becomes constant.

A groove which vacuum adsorbs the substrate W to be treated is formed on the top surface of the above-described spinner 22, a pipe which forms the above-described circulation path 9 is disposed within the groove formed on the top surface of the support portion 21, and a cleaning nozzle 24 which cleans a developing solution which has flown behind the rear surface of the substrate W to be treated is disposed in a position which is nearest to the inside diameter of the top surface of the support portion 21.

On the other hand, in the above-described nozzle device 3, a spray nozzle 33 is attached to a horizontally reciprocating arm 31 via a columnar support 32. A developing solution pipe 34 and an air supply pipe 35 are inserted into this spray nozzle 33 (see FIG. 3) and a temperature-regulated developing solution from the developing solution supply pipe 34 is spouted in mist form from the bottom end of the spray nozzle 33.

The spray nozzle 33 is housed within a cap-like cone 36 attached to the columnar support 32 and the spread of the mist is suppressed by this cone 36. Incidentally, although the mist adhering to the cone 36 becomes a developing solution and drops upon the front surface of the substrate, this does not produce an adverse effect on development treatment, because the top of the substrate is constantly covered with the developing solution.

FIG. 4 is a view to explain the piping system and FIG. 5 is an enlarged sectional view of a temperature regulating portion (heater) for an applied solution. The developing solution supply pipe 34 and the air supply pipe 35 are each provided with a valve, and heaters 37, 38 are provided on the upstream side of each of the valves and a buffer tank 39 is provided particularly at a midpoint in the developing solution supply pipe 34. In the buffer tank 39, by monitoring the amount of the developing solution by use of a liquid level sensor not shown in the figure, it is possible to supply a developing solution which is constantly stable without a shortage of the solution.

As shown in FIG. 5, the above-described heater 37 may be of a double-pipe construction in which the developing solution supply pipe 34 is inserted in a pipe which constitutes the circulation path 9 of temperature-regulated water so that the temperature of the developing solution can be arbitrarily controlled in the range of not less than 30° C. but less than 60° C. Incidentally, it is advisable that to ensure that the stream or flow direction of the temperature-regulated water is opposed to the stream of the developing solution as shown.

Although in the illustrated example the chuck device 2 and the nozzle device 3 are heated by the temperature-regulated water, the air to be mixed with the developing solution (air supply pipe 35) may be heated by adopting a double-pipe construction in the same way as in FIG. 5. Furthermore, the developing solution and air may be heated by means other than the temperature-regulated water.

Figure 6A:
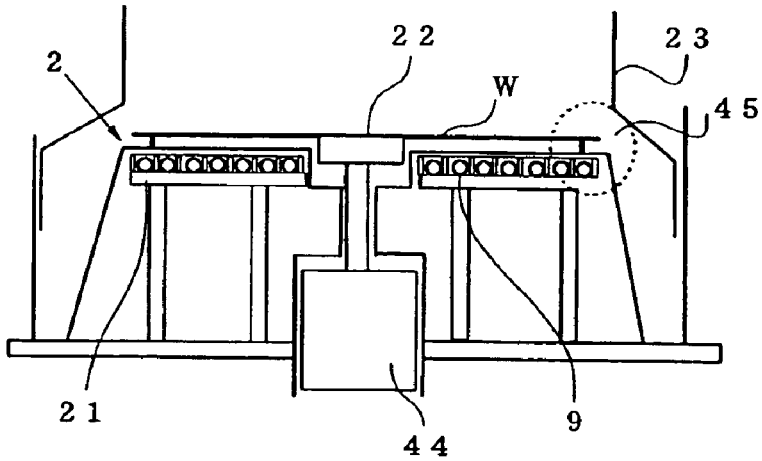
FIG. 6(*a*) is a partial enlarged view similar to that in FIG. 2, in which a convex projecting body is provided on the bottom surface of a cup.
Figure 6B:
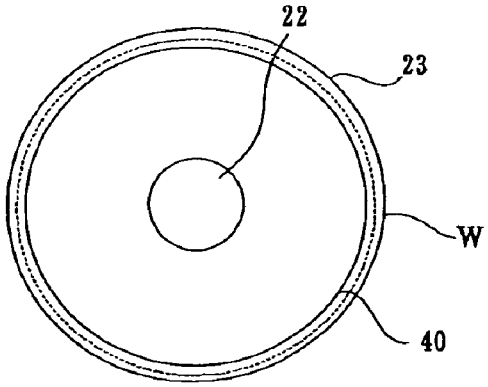
Figure 6C:
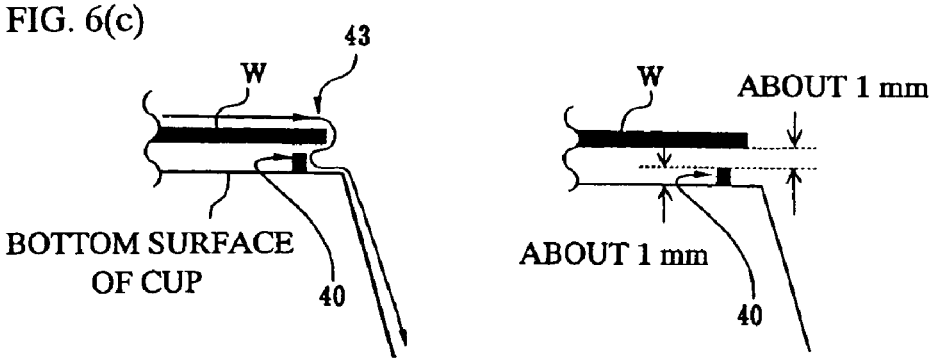

FIG. 6(*a*) to FIG. 6(*c*) show an example in which a projecting body 40 which prevents the developing solution from flowing behind a rear surface of the wafer is provided. FIG. 6(*a*) is a view similar to FIG. 2 which shows another embodiment of the invention, FIG. 6(*b*) is a plan view of the chuck portion, and FIG. 6(*c*) are views to explain the action of the projections.

In this embodiment, the spinner 22 permits the temperature holding and rotation of the substrate W, which is the object to be treated, and the support portion 21 serves to hold the temperature of the substrate W to be treated. The height of the support portion 21 is a little lower than the height of the spinner 22. Because the support portion 21 is a little lower, a surplus developing solution etc. may flow behind the rear surface of the wafer W, which is the object to be treated. For this reason, it is desirable to provide a ring-shaped projecting body 40 with a gap of about 1 mm from the lower or rear surface of the wafer W to be treated in a position which is nearest to the outside diameter or periphery of the support portion 21 and is within 10 mm from the outermost edge of the wafer W to be treated. This prevents the developing solution etc. from flowing behind the rear surface of the substrate W to be treated due to surface tension. As shown, the projecting body is provided on a bottom (upper) surface of the cup facing toward the lower surface of the object to be treated.

Figure 7A:
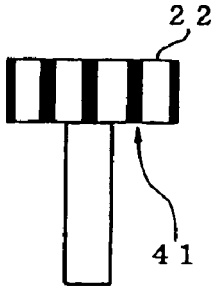
FIG. 7(*a*) to FIG. 7(*c*) are various views of projections provided with a spinner according to an embodiment of the invention.
Figure 7B:
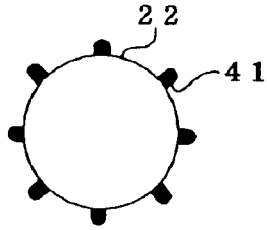
Figure 7C:
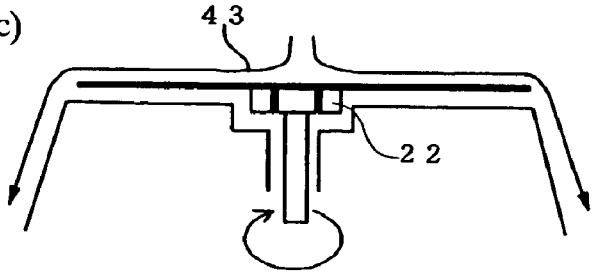

FIG. 7(*a*) to FIG. 7(*c*) show another embodiment of the invention for preventing the developing solution from flowing behind the rear surface of the substrate to be treated. FIG. 7(*a*) is a side expanded view a spinner 22 with projections 41. FIG. 7(*b*) is a plan view of FIG. 7(*a*) and FIG. 7(*c*) shows a path in which the developing solution flows down without flowing behind the rear surface of the substrate to be treated. In this embodiment, projections 41 are provided in a plurality of places on the outside of the spinner 22 present on the rear surface side of the substrate W to be treated in such a manner that the projections do not interfere with other members by the mounting and rotation of the substrate W to be treated. The rotation of the spinner 22 with the projections 41 causes air currents to be generated toward the outside diameter on the rear surface of the wafer W to be treated. Because in the region of the rear surface of the wafer, the gap between the substrate W to be treated and the chuck is as narrow as 1 mm or so in areas other than the portion where the spinner 22 is housed, this provides the amplification effect that the wind force is amplified when the air flows out to the peripheral part of the wafer. Therefore, it is possible to cause the developing solution etc. to scatter efficiently and, at the same time, it is possible to prevent the developing solution etc. from flowing behind the rear surface of the substrate W to be treated. The wind volume generated by the multiple projections 41 attached to the spinner 22 is not so large as described in Patent Document 4 and Patent Document 5. However, due to the above-described amplification effect, it is possible to generate air currents of wind force large enough to prevent the developing solution flying from the front surface of the wafer W to be treated from flowing behind the rear surface of the wafer W to be treated. The corners of the projections 41 are rounded to reduce the air resistance and hence to minimize the load to the spinner 22.

TABLE 1

| | Treatment time (min) | Amount of solution used (cc) | Possibility of uniform development |
|---|---|---|---|
| Inventive developing solution in mist form (40° C.) | 2 | 100 | ○ |
| | 1.5 | 75 | ○ |
| Paddle type (23° C.) | 6 | 240 | ○ |
| | 5 | 240 | ○ |
| | 4 | 240 | x |
| Paddle type (40° C.) | 2 | 200 | ○ |
| Shower type (23° C.) | 6 | 1800 | ○ |
| | 5 | 1500 | ○ |
| | 4 | 1200 | ○ |
| | 3 | 900 | x |

As is apparent from the foregoing (the above table), according to the present invention, even in the case of the paddle type, the developing solution is formed in mist from and temperature regulation is performed. Therefore, the treatment time is shortened, the amount of the solution used is reduced and uniform development treatment has become possible.

By providing the convexities or projecting body 40, and projections 41 on the spinner 22 and the bottom surface of the cup, it is possible to prevent the developing solution from flowing behind the rear surface of the wafer.

Although there have been described what are the present embodiments of the invention, it will be understood that variations and modifications may be made thereto without departing from the spirit or essence of the invention.

What is claimed is:

1. A paddle type developing apparatus of photoresist in which a developing solution from a nozzle is supplied to an object to be treated, which is held by a chuck device including a spinner, and the developing solution on the object to be treated is thrown off by rotating the spinner after a lapse of a prescribed time, wherein the paddle type developing apparatus comprises a nozzle which mixes a developing solution and air and spouts a developing solution in mist form and at least part of a developing solution pipe leading to this nozzle is disposed within a circulation path of temperature regulating water.

2. The developing apparatus according to claim 1, wherein part of the circulation path of said temperature regulating water is formed in said chuck device and the temperature of said chuck device is adjusted in said part of the circulation path.

3. The developing apparatus according to claim 1, wherein at least part of an air pipe which supplies air to be mixed with said developing solution is disposed within the circulation path of said temperature regulating water.

4. The developing apparatus according to claim 1, wherein the developing apparatus further comprises a blower which feeds temperature-regulated air into the developing apparatus and a preheating device which heats the object to be treated before transfer of the object into the developing apparatus.

5. The developing apparatus according to claim 1, wherein the chuck device includes a cup and a surface of said cup is provided with a projecting body which prevents the developing solution from flowing behind a rear surface of the object to be treated.

6. The developing apparatus according to claim 1, wherein the spinner is provided with convex projections which generate air currents in a radial direction on a rear surface of the object to be treated when the spinner is rotated.

7. The developing apparatus according to claim 1, further comprising an antiscattering cup in which said nozzle which spouts a developing solution in mist form is disposed.

8. A developing method which uses the developing apparatus according to claim 1, wherein a regulated temperature of said developing solution, a regulated temperature of said chuck device, a regulated temperature of said air to be mixed with the developing solution and/or a regulated temperature of air to be fed into the developing apparatus is not less than 30° C. but less than 60° C.

9. A developing method which uses the developing apparatus according to claim 1, wherein the developing method is applied to the development treatment of a thick film photoresist of not less than 10 $\mu$m.

10. A developing method according to claim 8, wherein the developing method is applied to the development treatment of a thick film photoresist of not less than 10 $\mu$m.

11. A developing method according to claim 8, wherein each of the regulated temperature of said developing solution, the regulated temperature of said chuck device, the regulated temperature of said air to be mixed with the developing solution and the regulated temperature of said air to be fed into the developing apparatus is not less than 30° C. but less than 60° C.

12. The developing apparatus according to claim 5, wherein said cup is disposed with a bottom surface thereof facing the object to be treated in close proximity thereto, and said projecting body is disposed on said bottom surface near an outer periphery of the object to be treated.

13. The developing apparatus according to claim 6, wherein projecting edges of said convex projections are rounded.

14. The developing apparatus according to claim 7, wherein said antiscattering cup is cone shaped.

15. A developing method which uses the developing apparatus according to claim 4, wherein a regulated temperature of said developing solution, a regulated temperature of said chuck device, a regulated temperature of said air to be mixed with the developing solution and/or a regulated temperature of air to be fed into the developing apparatus is not less than 30° C. but less than 60° C.

16. A developing method which uses the developing apparatus according to claim 4, wherein the developing method is applied to the development treatment of a thick film photoresist of not less than 10 $\mu$m .

17. A developing method which uses the developing apparatus according to claim 5, wherein a regulated temperature of said developing solution, a regulated temperature of said chuck device, a regulated temperature of said air to be mixed with the developing solution and/or a regulated temperature of air to be fed into the developing apparatus is not less than 30° C. but less than 60° C.

18. A developing method which uses the developing apparatus according to claim 5, wherein the developing method is applied to the development treatment of a thick film photoresist of not less than 10 $\mu$m.

19. A paddle type developing apparatus of photoresist in which a developing solution from a nozzle is supplied to an object to be treated, which is held by a chuck device including a spinner, and the developing solution on the object to be treated is thrown off by rotating the spinner after a lapse of a prescribed time, wherein the paddle type developing apparatus comprises a nozzle which mixes a developing solution and air and spouts a developing solution in mist form and a temperature regulating mechanism which regulates temperature of at least part of a developing solution pipe leading to the nozzle.

20. The developing apparatus according to claim 19, wherein said temperature regulating mechanism also regulates temperatures of said chuck device and at least part of an air pipe which supplies air to be mixed with said developing solution by said nozzle.

* * * * *

UNITED STATES PATENT AND TRADEMARK OFFICE

CERTIFICATE OF CORRECTION

PATENT NO. : 6,893,172 B2 
DATED : May 17, 2005
INVENTOR(S) : Akihiko Nakamura and Yoshihiro Inao It is certified that error appears in the above-identified patent and that said Letters Patent is hereby corrected as shown below:

Column 3,
Line 59, change “4 of the chuck portion” to -- of the chuck portion --.

Column 6,
Line 30, change “formed in mist from” to -- formed in mist form --.

Signed and Sealed this

Fifteenth Day of November, 2005

JON W. DUDAS
*Director of the United States Patent and Trademark Office*